US007913618B2

(12) United States Patent
Ferry et al.

(10) Patent No.: US 7,913,618 B2
(45) Date of Patent: Mar. 29, 2011

(54) PUNCH PRESS TOOL FOR STAMPING SUCCESSIVE MULTICHARACTER IMPRESSIONS INTO A WORKPIECE

(75) Inventors: Gregory S. Ferry, Milaca, MN (US); David A. Berry, Fridley, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 950 days.

(21) Appl. No.: 11/820,827

(22) Filed: Jun. 21, 2007

(65) Prior Publication Data

US 2008/0314220 A1 Dec. 25, 2008

(51) Int. Cl.
*B44B 5/00* (2006.01)
*B44B 5/02* (2006.01)
*B41K 3/10* (2006.01)

(52) U.S. Cl. ..... 101/3.1; 101/18; 101/29; 101/87; 101/88; 101/109

(58) Field of Classification Search ..... 101/3.1, 101/13, 28, 29, 14, 15, 16, 17, 31.1, 35, 87, 101/88, 105, 111, 109, 103, 18, 84, 85, 110; *B44B 5/00, 5/02; B31F 1/07; B41K 1/16, B41K 1/18, 3/10*

See application file for complete search history.

(56) References Cited

U.S. PATENT DOCUMENTS 1,407,769 A * 2/1922 Premo ..... 101/18
4,397,233 A 8/1983 Mori
5,072,620 A * 12/1991 Hill et al. ..... 72/414
5,081,891 A 1/1992 Johnson et al.
5,382,102 A * 1/1995 Brolund et al. ..... 400/134
5,647,256 A 7/1997 Schneider
5,832,798 A 11/1998 Schneider et al.
5,839,341 A 11/1998 Johnson et al.
5,848,563 A 12/1998 Saito
5,884,546 A 3/1999 Johnson
5,993,090 A 11/1999 Straka et al.
6,074,330 A 6/2000 Ostini
6,196,103 B1 3/2001 Schneider et al.
7,032,812 B2 4/2006 Ostini

OTHER PUBLICATIONS

Pryor Co., Ltd., Pryor Series 2000 Automatic Numbering Head, published by Pryor Co. Ltd. of Sheffield, England, Published 2000.
Conic Co., Ltd., Number Marking Tool, published by CONIC Co., Ltd., 10-5 Taiheidai, Shoo-cho, Katsuta-gun, Okayama, 709-4321, Japan, Published 2007.

* cited by examiner

*Primary Examiner* — Judy Nguyen
*Assistant Examiner* — Jennifer Simmons
(74) *Attorney, Agent, or Firm* — James V. Harmon; Nikolai & Mersereau, P.A.

(57) ABSTRACT

A punch press tool for stamping successive multicharacter impressions into a workpiece such as a piece of steel, sheet metal, or other workpiece, includes a guide body in which a stamp driver is slidably mounted for being driven downwardly toward the workpiece by a punch press ram which is a standard part of a high speed commercial punch press. A multicharacter marking stamp is supported at the lower end of the stamp driver for reciprocal movement therewith. The marking stamp includes multicharacter wheels that are rotated automatically during operation for advancing characters in sequence responsive to the movement of a character advancing arm. At least one character stamp operating lever is operatively associated with the punch press tool for articulation responsive to motion imparted to the tool by the ram. The lever has an operating element that is operatively associated with the character advancing arm of the multicharacter stamp for indexing the arm to enable successive characters thereof to be placed in an operating position responsive to a stroke of the punch press ram.

7 Claims, 7 Drawing Sheets

PUNCH PRESS TOOL FOR STAMPING SUCCESSIVE MULTICHARACTER IMPRESSIONS INTO A WORKPIECE

FIELD OF THE INVENTION

This invention relates to the punch and die art and more particularly to a punch press stamping tool for marking a workpiece with a stamped impression of numbers or letters in its surface.

BACKGROUND OF THE INVENTION

In the punch and die art and particularly in the field of high-speed automated forming and punching equipment for punching and forming sheet material, e.g., sheet metal and especially in the case of automated turret punch presses, the punch presses are operated by computer to rapidly perform a series of punching or forming operations. These punch presses which by themselves form no part of the present invention are typically provided with an upper turret and a lower turret that rotate and are indexed intermittently between punching operations. The turrets may, for example, hold as many as a dozen or more separate punches such as hole punches that are used one after another for performing given operations. When a punch is struck from above by the ram of the punch press, the punch element or punch insert is driven downwardly through the workpiece to perform the punching or forming operation. When released, the punch insert is retracted by a spring provided in the punch assembly.

While there have been several attempts to provide a satisfactory marking tool for punch presses, the prior tools are provided with characters that must be changed manually or in other equipment are able to make an impression of only one letter or number at a time. U.S. Pat. No. 5,993,090, for example, describes a marking punch provided with twelve letters, each of which is punched separately. So, for example, to punch the number 2007 would require four punch strokes and some mechanism for rotating the punch shaft between strokes but none is provided. U.S. Pat. No. 4,397,233 describes an automatic numbering assembly that instead of making an impression into the workpiece, transfers ink from an ink roller to a package as the drum rotates. Thus, the patented device is not suitable for making an impression in metal nor for being operated by the reciprocating ram of a punch press. A multicharacter punch numbering stamp has been made for a punch press by the Conic Company Ltd. of Okayama, Japan, but the digits of the numbering wheel must be individually set by hand between stamping operations. Thus each time the machine is run, it will continue to stamp the same number until the press is stopped and the wheels are rotated by hand to provide a new number. While numbering devices themselves are available commercially, there is no way to operate them using a high speed computer controlled punch press. Consequently, as far as the applicants were able to determine, no punch press tool for stamping successive multicharacter impressions into a workpiece has been developed that is able to be actuated by the rapidly reciprocating ram of an automated punch press and is capable of successively stamping numbers or other characters in sequence into a workpiece such as a sheet of metal.

In view of these and other deficiencies of the prior art, it is one object of the present invention to find a way to enable a high speed computer operated punch press to reliably impress alphanumeric characters or other indicia a selected depth into the surface of a workpiece and to advance the characters each cycle of the press ram.

Another object of the invention is to provide a device of the kind described in which the characters to be stamped are extended out below the unit but not far enough to strike objects unintentionally as the punch press operates and are preferably able to accommodate workpieces of various thicknesses.

These and other more detailed and specific objects and advantages of the present invention will be better understood by reference to the following figures and detailed description which illustrate by way of example but a few of the various forms of the invention within the scope of the appended claims.

SUMMARY OF THE INVENTION

Briefly, the present invention provides a punch press tool for stamping successive multicharacter impressions in a workpiece such as a piece of steel, sheet metal, or other workpiece, that includes a guide body in which a stamp driver is slidably mounted for being driven downwardly toward the workpiece by a punch press ram which is a standard part of a high speed commercial computer operated punch press. A multicharacter marking stamp is supported at the lower end on the stamp driver for reciprocal movement therewith. The marking stamp includes multicharacter wheels that are rotated automatically during operation for advancing characters in sequence responsive to the movement of a character advancing arm. At least one character stamp operating lever is operatively associated with the advancing arm of the stamp driver and is arranged for articulation responsive to the motion of the punch press tool. On the operating lever is a pressure element that is operatively associated with the character advancing arm of the multicharacter stamp for indexing the arm to sequentially position successive characters in an operative position responsive to a stroke of the punch press ram that drives the characters of the marking stamp into the workpiece.

DETAILED DESCRIPTION OF PREFERRED EMBODIMENTS

Figure 1:
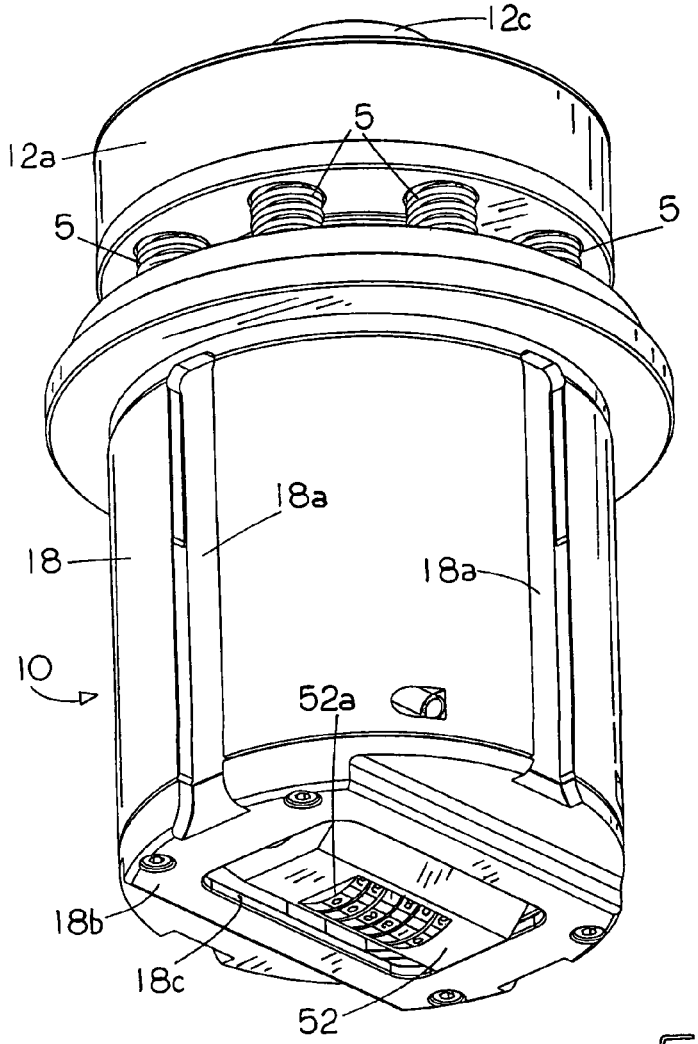
FIG. 1 is a bottom perspective view of a punch press tool in accordance with the invention, showing its marking stamp in the operating (extended) position.
Figure 2:
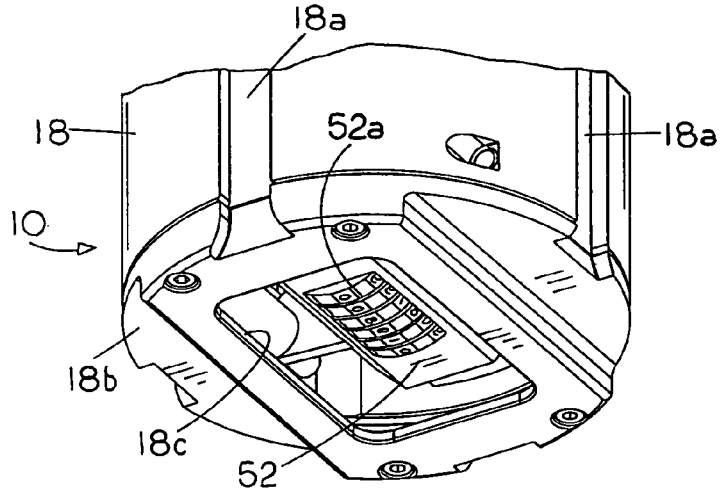
FIG. 2 is a fragmentary view of FIG. 1 with the stamp in its raised (inoperative) position.
Figure 3:
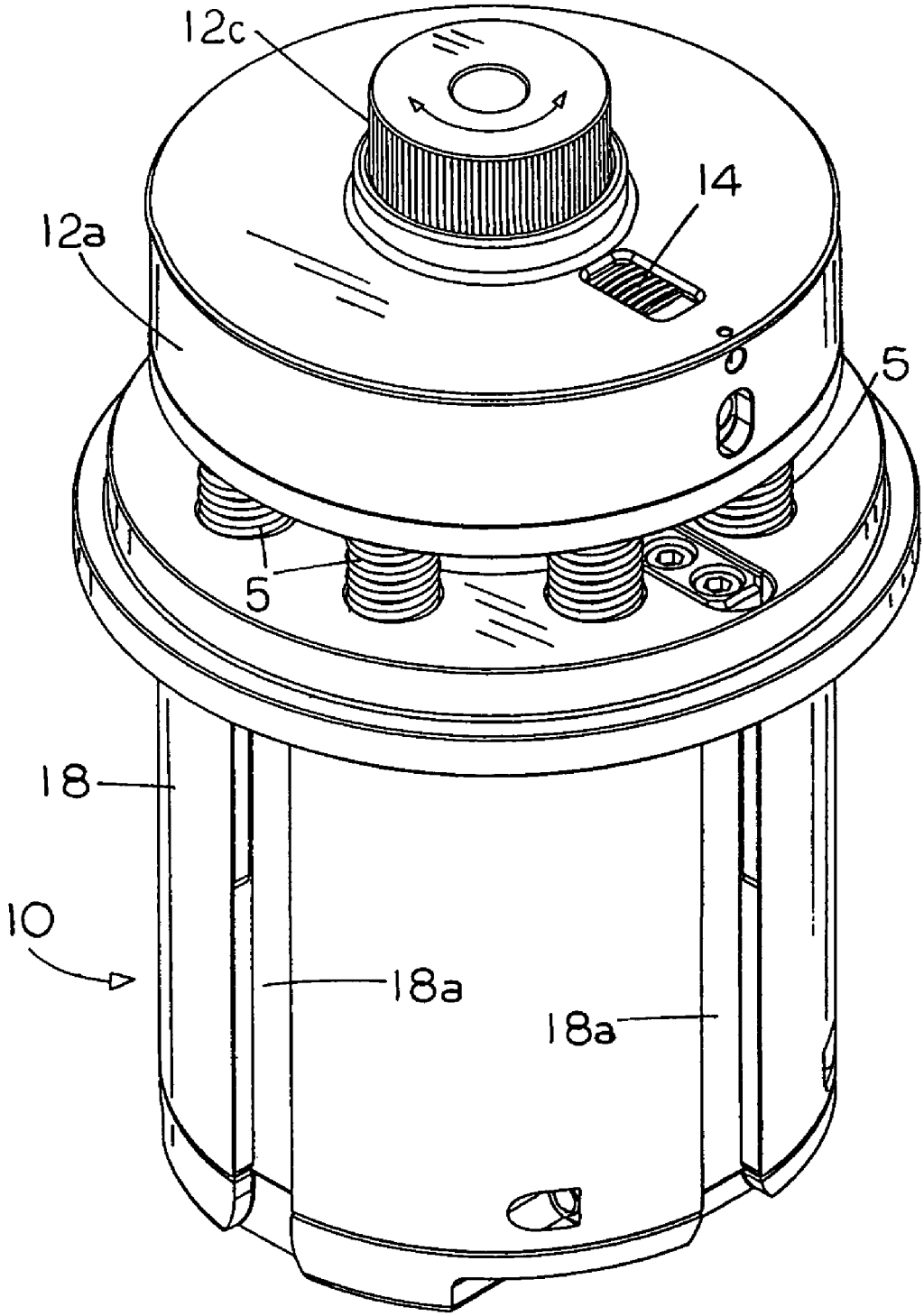
FIG. 3 is a top perspective view of the press tool of FIG. 1.

In FIGS. 1-3 the punch press tool according to the invention, indicated generally by the numeral 10 comprises two major parts; a guide body 18 and a stamp driver 12 of cylindrical shape having a cylindrical boss 12*a* at its upper end that is bored at 12*b* to receive an adjustable striker head 12*c* of cylindrical shape which is screw threaded into the lower portion of the stamp driver by means of threads 12*d*. The lower part of the stamp driver 12 is slidably mounted in a vertically disposed bore 16 in the guide body 18 which is provided on its outer surface with circumferentially spaced apart longitudinally extending keyways 18*a* for holding it at the proper angle about a vertical axis.

Figure 4:
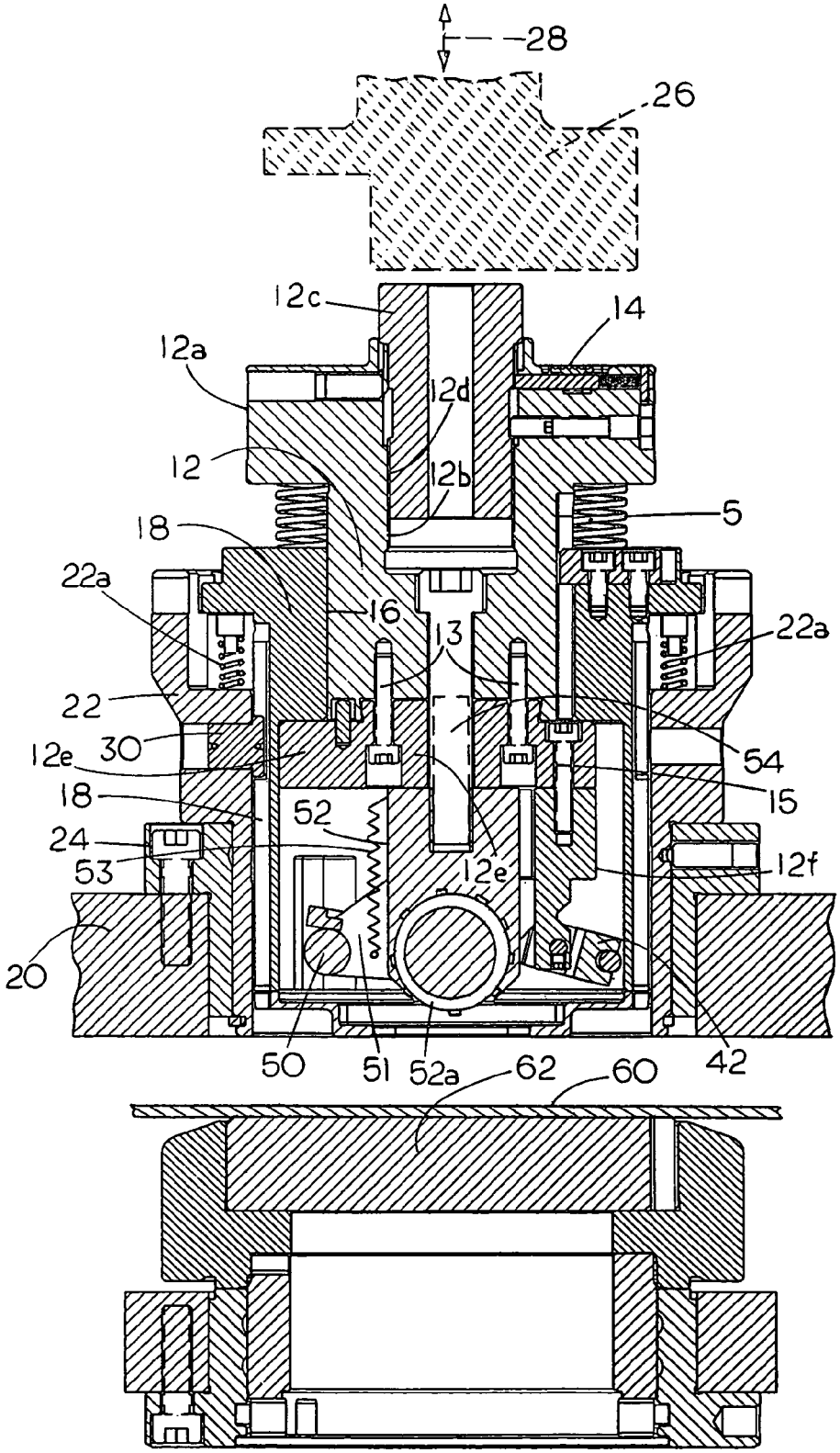
FIG. 4 is a central vertical sectional view of the tool of FIGS. 1-3 with the stamp in the up or retracted position.
Figure 5:
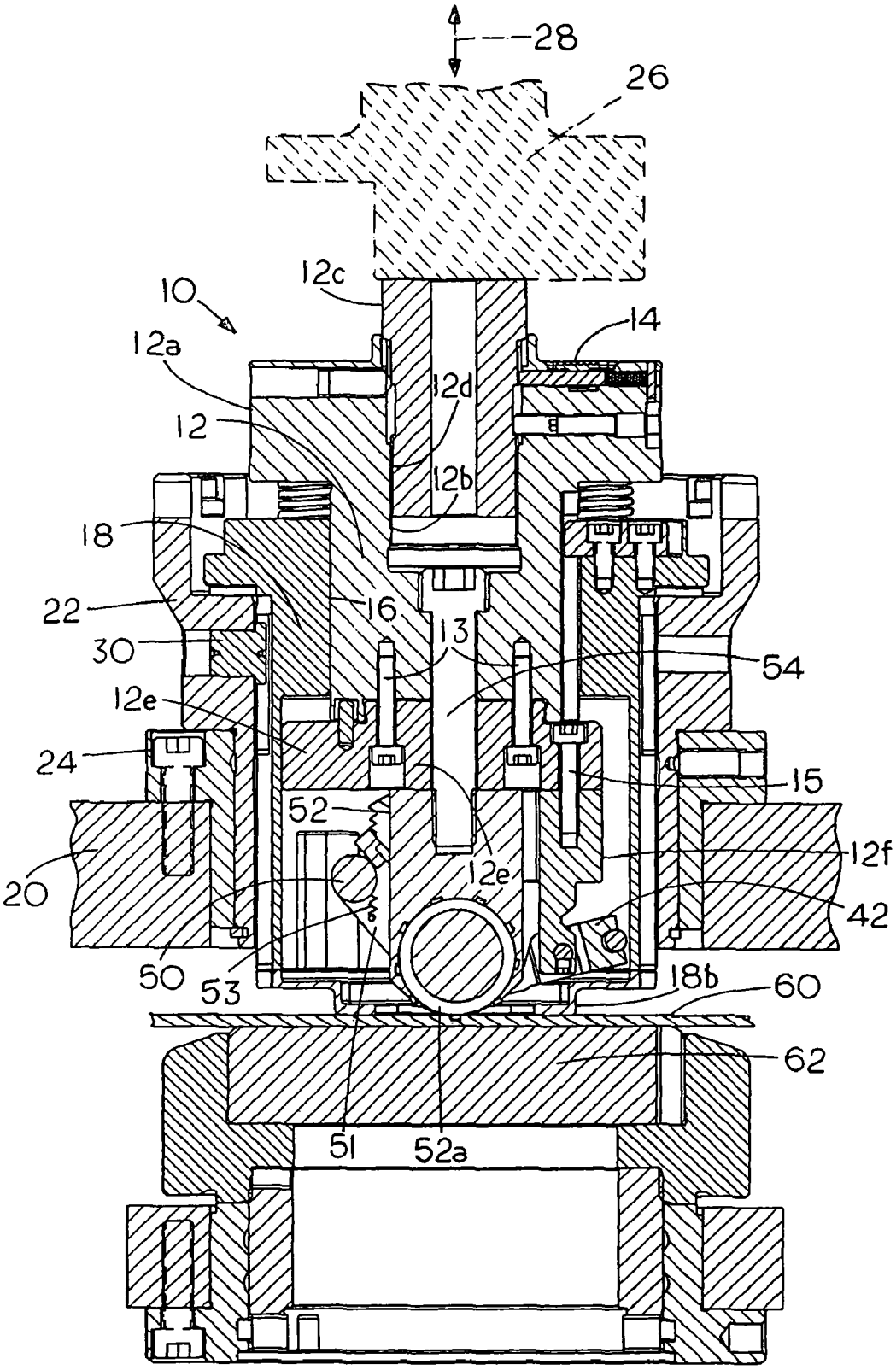
FIG. 5 is a view similar to FIG. 4 with the stamp in the down or operating position.
Figure 6:
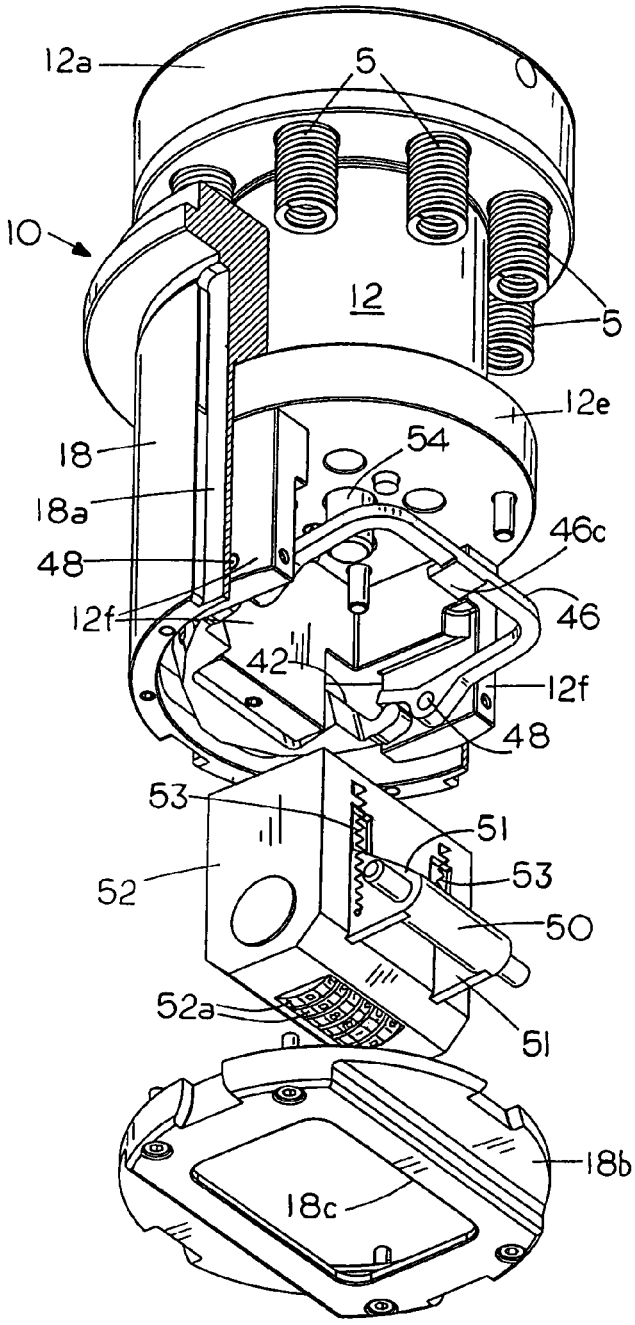
FIG. 6 is a bottom exploded perspective view of the tool of FIGS. 1-5.
Figure 7:
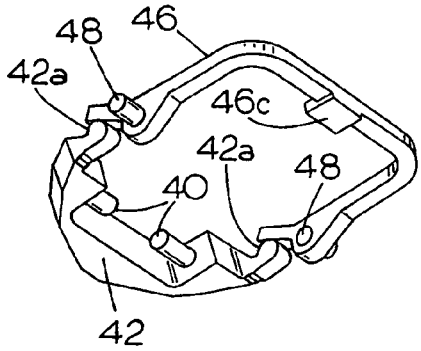
FIG. 7 is a bottom perspective view of stamp operating levers of FIG. 6.

FIGS. 4 and 5 show how during use, the stamping tool 10 is mounted for operation on the upper turret 20 of a punch press by being placed within a circular tool holder 22 of conventional well known construction that is itself supported within an adapter ring 24. The tool 10 is supported on the tool holder 22 by means of lifter springs 22*a*. In operation, the upper punch press turret 20 rotates rapidly on a vertical axis (not shown) which is behind the tool 10 to place various tools in alignment with the punch ram 26 of the punch press as the ram reciprocates on a vertical axis indicated by an arrow 28 to strike whichever tool mounted on the turret is located in the punching station beneath the reciprocating ram 26. One or more keys 30 in the tool holder 22 maintain the guide body 18 in the correct angular position about a vertical axis during operation. Between the stamp driver 12 and the guide body 18 are mounted several compression springs 5 for elevating the stamp driver between strokes. The stamp driver 12 has at its lower end a stamp driver end plate 12*e* which is held in place by bolts 13 and a lever bracket 12*f* which is secured in place by a bolt 15.

Other punch assembly units of various designs suited for use in a high speed punch press are described in U.S. Pat. Nos. 5,054,347 and 6,895,787 as well as U.S. Pat. Nos. 7,658,134 and 7,726,554 which are all incorporated herein by reference.

Figure 8:
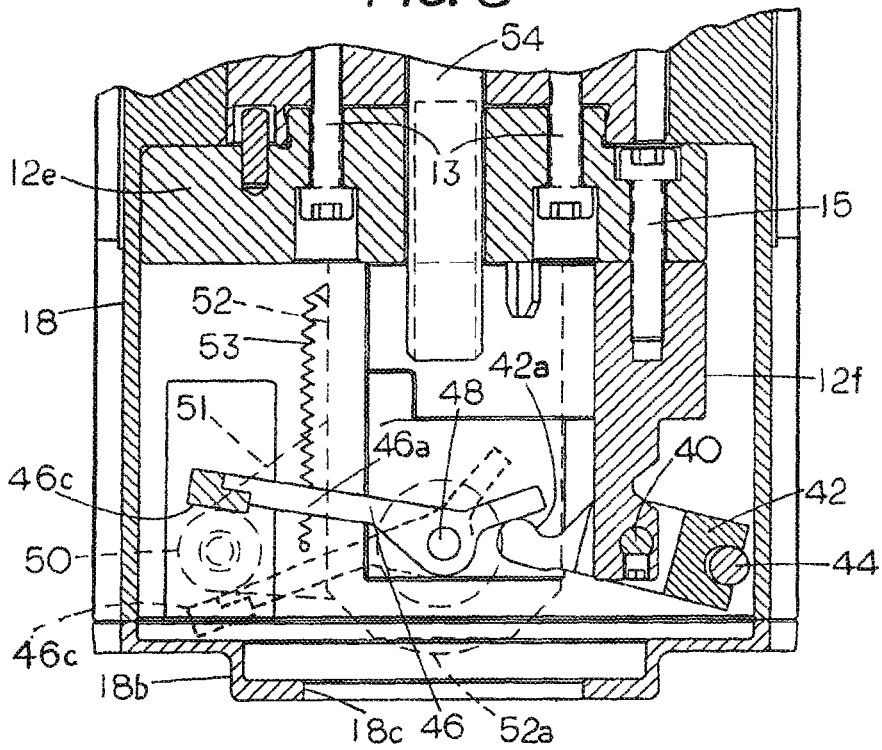
FIG. 8 is a partial vertical sectional view similar to FIG. 4 but with the character stamp removed.

Characters provided on a marking stamp 52 are advanced by an operating lever assembly that in FIGS. 1-8 comprises a driving lever 42 and a driven lever 46. Attached to the lower end of the lever bracket 12*f* of stamp driver 12 by a set screw or other fastener are horizontal pivot pins 40 upon which is pivotally mounted the generally U-shaped character stamp operating lever 42 (the driving lever) the outer end of which is pivotally secured to a horizontally disposed pivot pin 44 that is carried by the guide body 18. As seen best in FIGS. 6 and 7, the inner free ends of the U-shaped lever 42 have upwardly facing convex working surfaces 42*a* that are engaged as shown in FIG. 8 with the free end at the right of a second stamp operating lever 46 (a driven lever) which is mounted for pivotal movement on horizontal pins 48 also carried on bracket 12*f* (FIG. 6) of the stamp driver 12. Thus, as lever 42 pivots counterclockwise its working surface 42*a* allows lever 46 to pivot in the opposite direction but lever 42 is not physically connected to lever 46. The lever 46 extends from pivots 48 toward the left at 46*a* and has on its lower surface an operating pad or other pressure applying element 46*c* that is engaged during use with the upper surface of a roller 50 which is secured to the free end of a character advancing arm 51 of the multicharacter marking stamp 52 (shown in dotted lines in FIG. 5) which is itself affixed to the lower end of the stamp driver 12 by a draw bolt 54 so that during operation as the ram 26 of the punch press reciprocates, its engagement with the striker head 12*c* drives the stamp driver 12 downwardly through the guide body 18 thereby forcing the marking stamp 52 downwardly and into contact with a workpiece 60 which is supported on an anvil 62 so as to form an impression in its upper surface.

It can be seen that the invention allows the lengths of the lever arms of levers 42 and 46 to be chosen so as to move the operating pad 46*c* any desired distance as the ram and the stamp driver 12 reciprocate; whatever distance is correct for a particular actuator arm 51.

Figure 10:
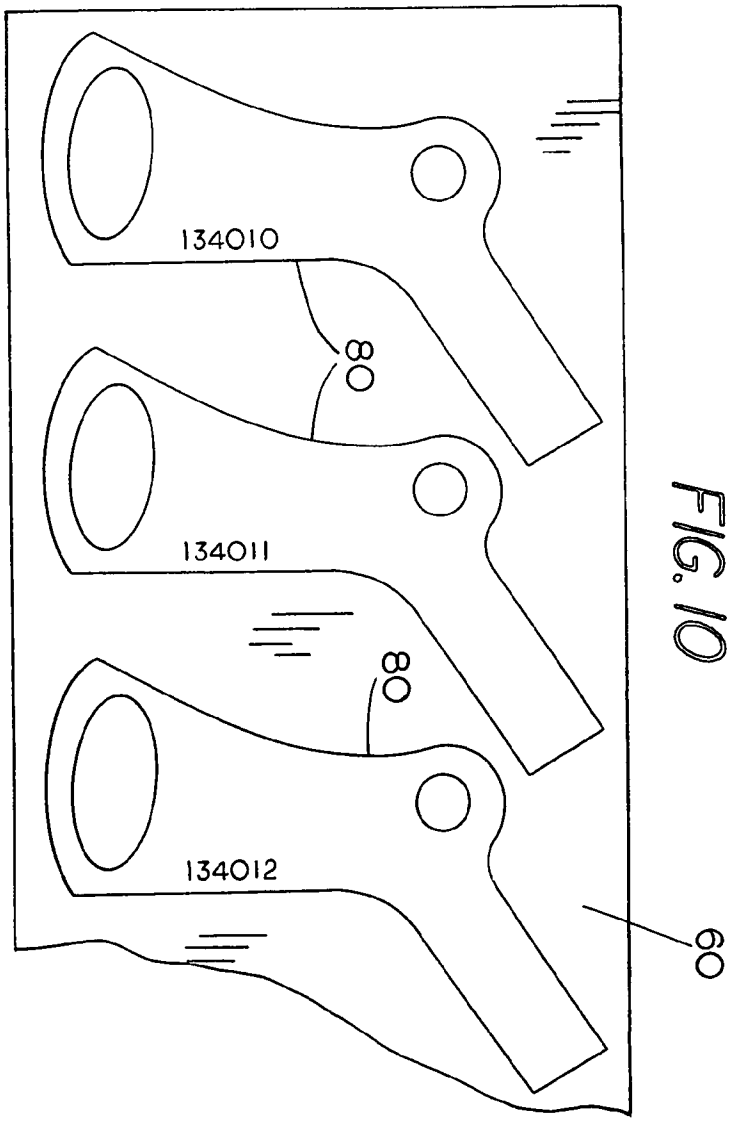
FIG. 10 is a plan view of a stamping made with the invention.

The marking stamp 52 can be of any suitable commercially available construction such as a series 2000 automatic numbering head manufactured by the Pryor Company Ltd. of Sheffield England. Other suitable automatic sequential numbering stamps are manufactured by the Numberall Stamp & Tool Company of Sangerville, Me., USA, and by Mecco Partners LLC of Ingomar, Pa., USA. These multicharacter marking stamps are each provided with multicharacter e.g. digital wheels 52*a* that are rotated incrementally during operation for sequentially advancing raised characters to place a series of letters or numbers located in an operating position at the bottom of the stamp so that the numbers or other characters increase or advance in a predetermined sequence responsive to the indexing of a character advancing arm 51 which swings up and down during operation through an arc so as to advance the number wheels one character at a time, each time the arm 51 is indexed upwardly by one or more return elements for biasing the arm 51 upwardly as pressure applied by the driven lever is released. The return element can be of any suitable construction such as a weight, compressed air, hydraulics, an electric solenoid, rubber or the like such as a pair of return springs 53 that are connected between the arm 51 and the top of stamp 52. The return spring 53 serves to advance the character wheels 52*a* of the stamp 52, whereas the stamp lever assembly forces the character advancing arm in the opposite direction (downwardly) to a retracted position against the tension of the return spring as the stamp driver 12 moves upwardly. Thus, in operation a downward stroke of the ram 26 drives the marking stamp and one or more of the raised characters that are in an operative position at the lower end of the stamp into the workpiece 60 to provide an impression of those characters in its upper surface typically with sequential numbers in successively stamped parts 80 (FIG. 10).

Secured to the lower end of the guide body 18 by means of screws or other suitable fasteners is a stripper 18*b* having a rectangular opening 18*c* for the character wheels 52*a* of the stamp 52. The stripper 18*b* serves to hold the workpiece 60 in place as the impression is made by the character wheels of the stamp 52. FIGS. 1 and 5 show how the character wheels 52*a* are extended downwardly and out through the opening 18*c* a short distance but not far enough to strike other objects as the press operates.

By manually retracting the height adjustment locking button 14, then raising or lowering the striker head 12*c* by rotating it manually so as to screw it up or down on the threads 12*b* on the stamp driver 12, the distance that the raised characters on the character wheels 52*a* protrudes through the opening 18*c* (FIGS. 1 and 5) can be accurately set at any selected amount to thereby accommodate workpieces 60 of any thickness while also controlling the depth of the character impressions into the surface of the workpiece 60.

To inactivate the stamp 52, the draw bolt 54 is disconnected from the stamp 52 which is removed. The driven operating lever 46 is then rotated 180° about pivot 48 to separate actuator advancing arm 51 from the driven operating lever 46. Stamp 52 is then replaced and the bolt 54 is connected. Operating lever 46 is then rotated to a position where it can rest on the stripper 18*b* i.e. on the opposite side of roller 50. This enables the stamp 52 to repeatedly impress the same number or other character into the workpiece 60 whenever desirable or necessary.

Figure 9:
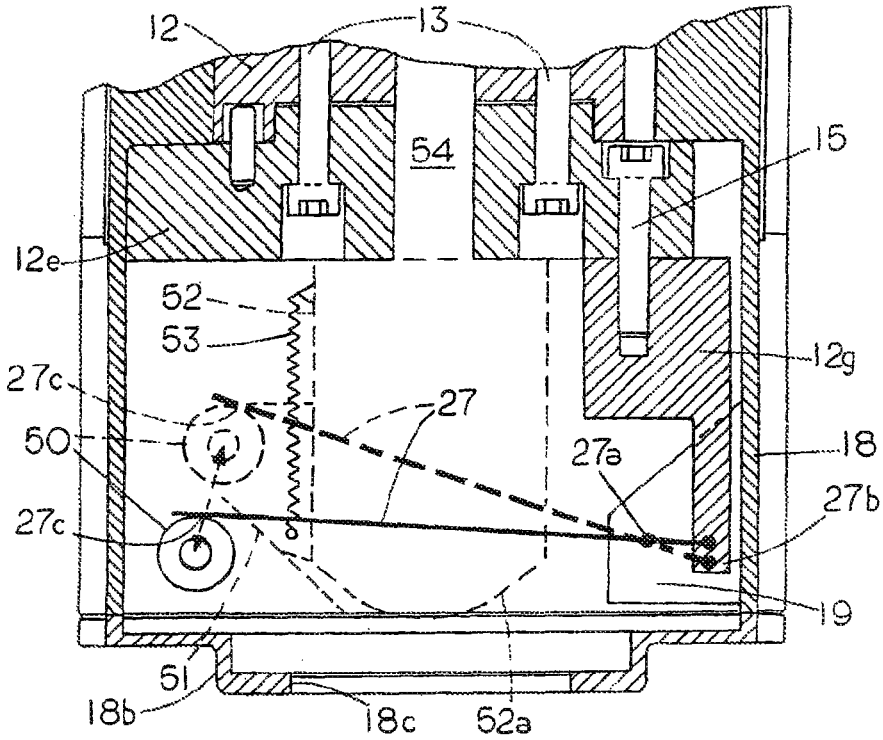
FIG. 9 is a partial vertical sectional view similar to FIGS. 5 and 8 showing. diagrammatically another embodiment of the invention with a single stamp operating lever.

Refer now to FIG. 9 which illustrates diagrammatically another possible operating lever assembly employing a single operating lever 27 having a fulcrum pivot 27*a* that is supported on a flange 19 which is connected to the guide body 18 and a movable pivot 27*b* at its outer end that is in turn connected to a modified lever bracket 12*g* spaced outboard of the fulcrum pivot 27*a* so as to cause operating surface 27*c* of the lever 27 to be raised when the stamp driver 12 is lowered. The springs 53 are then able to advance the characters on wheels 52*a* sequentially to the next appropriate number or letter as pressure on arm 51 is removed. The use of two levers 42 and 46 rather than one does, however, provide unexpected benefits; lever 46 can swing through a greater arc than a single lever and can have the same radius as arm 51. We also found that using two levers allows the stamp to be removed and the pressure pad 46*c* then placed in a position where it is inactive. Thus, the use of two levers rather than a single lever makes it possible to inactivate the stamp advancing mechanism when desired since it enables lever 46 to be moved to the opposite side of roller 50 i.e. below the roller where it cannot move the roller since in that position it is not in contact with working surface 42*a* of lever 42.

The invention provides outstanding results and unique capabilities. It was found that it is able to actuate a stamp 52 with a relatively short stroke of the ram, typically about 7 mm., even though the actuator arm 51 for the multicharacter stamp 52 must move much further; about 21 mm. while at the same time providing a way to inactivate or disengage the character stamp advancing mechanism when desired so that the stamp is able, when necessary, to continue stamping the same number or other set of characters. It is also able if and when necessary to index the stamp to the next digit or letter between strokes and not during the punching operation, in other words, the character stamp can be advanced during the upward stroke of the punch. Furthermore, the character stamp when in the operating position does not extend too far from the lower end of the tool where it could create an obstruction, i.e., where it might strike other objects as the tool is moved rapidly from one position to another while the press operates. In addition, it is capable of moving the character stamp actuator arm in the upward direction while a machine component (a guide body sleeve surrounding the character stamp) moves the opposite direction, i.e., downwardly. It is also able to regulate the stamp depth and to accommodate workpieces of different thicknesses.

Many variations of the present invention within the scope of the appended claims will be apparent to those skilled in the art once the principles described herein are understood.

What is claimed is:

1. A punch press tool for stamping successive multicharacter impressions into a workpiece comprising, a guide body adapted to be mounted upon a punch press for being positioned beneath an operating ram of the punch press, a stamp driver slidably mounted relative the guide body for being driven downwardly by the operating ram of the punch press, a multicharacter marking stamp supported on the stamp driver above the workpiece for reciprocal movement thereon to be driven downwardly toward the workpiece by the ram, said marking stamp having multicharacter wheels adapted to rotate for sequentially advancing raised characters thereon responsive to the movement of a character advancing arm, a stamp lever assembly having at least one character stamp operating lever operatively associated with the punch press tool for articulation responsive to movement imparted to the tool by a stroke of the punch press ram, said lever assembly also being operatively associated with the character advancing arm of the marking stamp for indexing the arm to sequentially position successive characters thereof responsive to a stroke of the punch press ram, each downward stroke of the ram drives successive raised characters of the marking stamp that are in an operative position downwardly into an upper surface of the workpiece to provide an impression of the characters therein, and the stamp lever assembly includes a driving lever having an outer end pivotally connected to the guide body, a central end operatively associated with one end of a driven lever and a pivotal connection to the stamp driver intermediate the ends thereof, said driven lever has an end portion opposite said one end that is operatively associated with the character advancing arm of the stamp and an intermediate pivotal connection to the stamp driver and said end portion of the driven lever is free to pivot upwardly when the stamp driver is forced downwardly through the guide body of the tool for operating said character stamp.

2. The punch press tool of claim 1 wherein the tool includes a return spring connected to the character advancing arm of the stamp for advancing the character wheel of the stamp and the stamp lever assembly is operatively associated with the character advancing arm for forcing the character advancing arm to a retracted position against the tension of said return spring.

3. The apparatus of claim 1 wherein the relative positions of the marking stamp and the lever assembly can be changed for disengaging the marking stamp character advancing arm from the lever assembly.

4. A punch press tool for stamping successive multicharacter impressions into a workpiece comprising, a guide body adapted to be mounted upon a punch press for being positioned beneath an operating ram of the punch press, a stamp driver slidably mounted in the guide body for being driven downwardly by the operating ram of the punch press, a multicharacter marking stamp supported on the stamp driver above the workpiece for reciprocal movement thereon to be drawn, said marking stamp having multicharacter wheels adapted to rotate for sequentially advancing raised characters thereon responsive to the movement of a character advancing arm, a stamp lever assembly having at least one character stamp operating lever connected between the guide body and the stamp driver for articulation responsive to relative motion therebetween, said lever assembly being operatively associated with the character advancing arm of the marking stamp for indexing the arm to sequentially position successive characters thereof responsive to a stroke of the punch press ram, a downward stroke of the ram drives one or more raised characters of the stamp that are in an operative position into the workpiece to provide an impression of the characters therein, the punch press tool includes a return element connected to the character advancing arm of the marking stamp for advancing a character wheel of the marking stamp, the stamp lever assembly is operatively associated with the character advancing arm for forcing the character advancing arm to a retracted position against the tension of said return element, and the stamp lever assembly includes a driving lever having an outer end pivotally connected to the guide body, a central end operatively associated with one end of a driven lever and a pivotal connection to the stamp driver intermediate the ends thereof, said driven lever has an end portion opposite said one end that is operatively associated with the character advancing arm of the stamp and an intermediate pivotal connection to the stamp driver and said end portion of the driven lever is free to pivot upwardly when the stamp driver is forced downwardly through the guide body of the tool for operating said character stamp.

5. The punch press tool of claim 4 wherein the return element comprises a spring.

6. A punch press tool for stamping successive multicharacter impressions into a workpiece comprising, a guide body adapted to be mounted upon a punch press for being positioned beneath an operating ram of the punch press, a stamp driver slidably mounted in the guide body for being driven downwardly by an operating ram of the punch press, a multicharacter marking stamp supported on the stamp driver above the workpiece for reciprocal movement thereon, said marking stamp having multicharacter wheels adapted to rotate for sequentially advancing raised characters thereon responsive to the movement of a character advancing arm, a stamp lever assembly having at least one character stamp operating lever connected between the guide body and the stamp driver for articulation responsive to relative motion therebetween, said lever assembly being operatively associated within the punch press tool with the character advancing arm of the marking stamp for indexing the arm to sequentially position successive characters thereof responsive to a stroke of the punch press ram, a downward stroke of the ram drives one or more raised characters of the stamp that are in an operative position downwardly into an upper surface of the workpiece to provide an impression of the characters therein, said tool includes a tool extension control for changing the distance that the character stamp extends below the ram, said control comprising a height adjustment member for changing the length of the tool between the upper end of the stamp driver and the character stamp to thereby establish the maximum distance that the characters of the character stamp are carried downwardly by the operation of the ram, and wherein the stamp lever assembly includes a driving lever having an outer end operatively associated with the guide body, a central end operatively associated but not attached to driven lever and said stamp lever assembly has a pivotal connection to the stamp driver intermediate the ends thereof, said driven lever has an end portion opposite said one end that is operatively associated with the character advancing arm of the stamp and an intermediate pivotal connection to the stamp driver and said end portion of the driven lever is adapted to pivot upwardly when the stamp driver is forced downwardly through the guide body of the tool for operating said character stamp.

7. The punch press tool of claim 6 wherein the extension control is operatively connected to a locking member for retaining the extension control in a selected position.

* * * * *